United States Patent [19]

McKenzie et al.

[11] 4,073,393

[45] Feb. 14, 1978

[54] CONTROL SYSTEM FOR REFUSE PACKER ASSEMBLY

[75] Inventors: Roland W. McKenzie; Richard Stansberry, both of Culpeper, Va.

[73] Assignee: City Tank Corporation, Culpeper, Va.

[21] Appl. No.: 790,141

[22] Filed: Apr. 22, 1977

Related U.S. Application Data

[63] Continuation of Ser. No. 754,071, Dec. 22, 1976, abandoned, which is a continuation of Ser. No. 629,701, Nov. 6, 1975, abandoned.

[51] Int. Cl.[2] ..... B65F 3/00

[52] U.S. Cl. ..... 214/83.3; 91/412; 137/596.15

[58] Field of Search ..... 214/83.3; 137/596.15, 137/596.14; 91/412

[56] References Cited

U.S. PATENT DOCUMENTS

| | | | |
|---|---|---|---|
| 3,233,525 | 2/1966 | Stacey | 91/412 |
| 3,615,028 | 10/1971 | Appleman | 214/81.3 |
| 3,760,962 | 9/1973 | Clucker | 214/81.3 |

*Primary Examiner*—Lawrence J. Oresky
*Assistant Examiner*—George F. Abraham

[57] ABSTRACT

A control system for operating fluid actuated components of a packer mechanism for a refuse collection vehicle comprising a fluid tank; a pump having an inlet communicating with the tank; a control valve having a main fluid passageway therethrough communicating at an inlet port thereof with the pump and at an outlet port thereof with the tank, a pilot fluid passageway therethrough communicating at an inlet port thereof with the pump and at an outlet port thereof with the tank, a first valve spool selectively operable for communicating the main fluid passageway with a component of the packer mechanism, the first spool being displaceable between a first position obstructing the pilot fluid passageway and a second position not obstructing the pilot fluid passageway, the first valve spool having a surface disposed normal to the axis thereof communicating with the pilot fluid passageway, and a second valve spool selectively operable for communicating the main fluid passageway with another component of the packer mechanism, the second valve spool being displaceable between a first position obstructing the pilot fluid passageway at a point thereof between the point of obstruction of the first valve spool and the outlet port of the pilot fluid passageway, and a second position not obstructing the pilot fluid passageway, the second valve spool having a surface disposed normal to the axis thereof communicating with the pilot fluid passageway; and means for shifting the valve spools into their second positions.

20 Claims, 10 Drawing Figures

CONTROL SYSTEM FOR REFUSE PACKER ASSEMBLY

This application is a continuation of application Ser. No. 754,071, filed Dec. 22, 1976, now abandoned, which was in turn a continuation of application Ser. No. 629,701 filed Nov. 6, 1975, now abandoned.

This invention relates to a control system and more particularly to a fluid control system for operating a packer mechanism mounted in a refuse receiving hopper of a refuse collection truck.

In the prior art, there has been developed a type of refuse collection vehicle which generally includes a refuse storage body mounted on a truck chassis, a refuse receiving hopper mounted on the rear end of the storage body, communicating interiorly with the storage body, and a mechanism mounted in the refuse receiving hopper, commonly referred to as a packer mechanism, for transferring refuse deposited in the hopper into the storage container and compacting the refuse therein.

A typical mechanism for transferring refuse from a refuse receiving hopper to a refuse storage body and compacting the refuse within the storage body, consists of a fluid actuated, rectilinearly moveable carrier unit, a fluid actuated packer panel pivotally mounted on the carrier unit and a fluid system for controlling the movements of the carrier unit and packer panel. In such a mechanism, the packer panel is adapted to pivot relative to the carrier unit to provide a sweeping action, and the carrier unit is adapted to reciprocate along its line of travel to position the packer panel over refuse charged into the receiving hopper preceeding the sweeping action of the packer panel and move the packer panel while in a downwardly disposed position for transferring the refuse forwardly into the storage body and compacting such refuse therein.

The movement of such packer panels and carriers usually are effected by means of fluid actuated piston and cylinder assemblies. Such assemblies are supplied with fluid under pressure by fluid control systems to operate such components in a predetermined sequence to provide a cycling of the packer panel. The sequence of operation of such components usually is controlled by a control valve which functions to supply fluid under pressure sequentially to selected sides of the piston and cylinder assemblies for the packer panel and carrier. Packer mechanisms of the type described, are disclosed and described in greater detail in U.S. Pat. Nos. 3,822,797 and 3,917,085.

Although control systems of the type disclosed in the aforementioned patents have proved to be satisfactory, it has been found to be desirable to provide an improved control system for a packer mechanism which improves the operating performance of the packer mechanism, and reduces manufacturing and maintenance costs thereof.

Accordingly, it is the principal object of the present invention to provide an improved fluid control system.

Another object of the present invention is to provide an improved control system for the packer mechanism of a refuse collection vehicle.

A further object of the present invention is to provide an improved control system for the packer mechanism of a refuse collection vehicle which utilizes less components than comparable systems in the prior art.

A further object of the present invention is to provide an improved control system for the packer mechanism of a refuse collection vehicle which is comparatively simple in design and operation, relatively inexpensive to manufacture and service and effective in performance.

Another object of the present invention is to provide a novel control valve.

A further object of the present invention is to provide a novel control valve suitable for use in a control system for operating the packer mechanism of a refuse collection vehicle.

Other objects and advantages of the present invention will become more apparent to those persons having ordinary skill in the art to which the present invention pertains, from the following description taken in conjunction with the accompanying drawings wherein.

Figure 3:
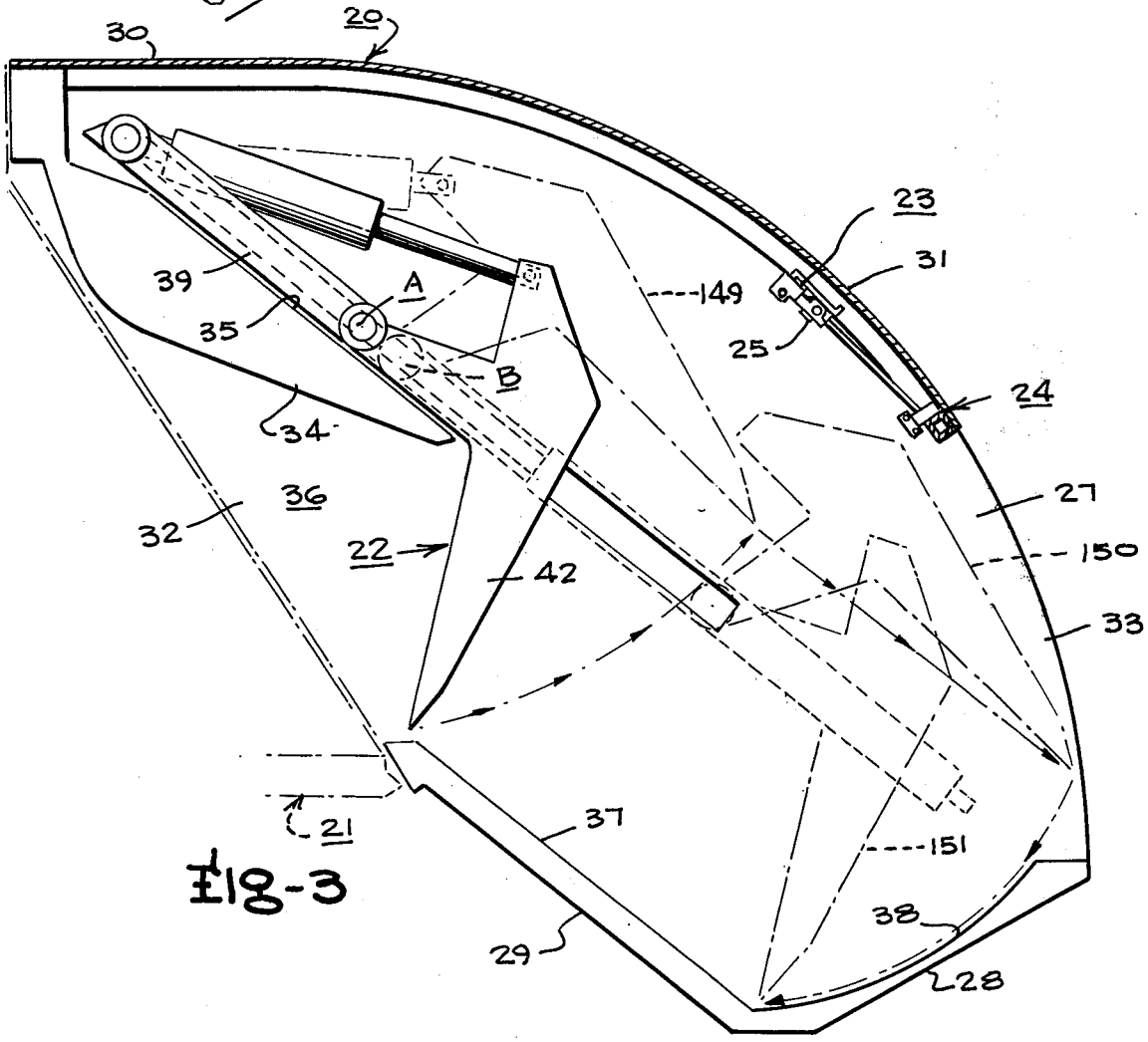
FIG. 3 is a vertical cross-sectional view of a refuse receiving hopper, illustrating a packer mechanism for transferring refuse charged into the hopper to a forwardly disposed storage body and compacting the refuse therein, and further illustrating a portion of the embodiment of the invention shown in FIGS. 1 and 2, mounted on the hopper.

Referring to FIG. 3, there is illustrated a refuse receiving hopper 20 mounted on the rear end of a refuse storage body 21 rigidly mounted on a truck chassis, a packer mechanism 22 mounted within the receiving hopper for transferring refuse charged into the receiving hopper, into the storage body and compacting the refuse therein, a fluid system 23 for operating the packer mechanism, and a mechanism 24 mounted on the receiving hopper for operating a control valve 25 of the fluid system.

Refuse storage body 21 consists of a bottom wall rigidly secured to the truck chassis, a pair of side walls and a top wall, defining a rearwardly disposed opening. Disposed within the storage body and moveable longitudinally along the length thereof is a transversely disposed ejector panel (not shown) against which refuse transferred into the storage body is compacted and which may be moved rearwardly to eject refuse in the storage body when the receiving hopper is lifted clear of the storage body.

Figure 2:
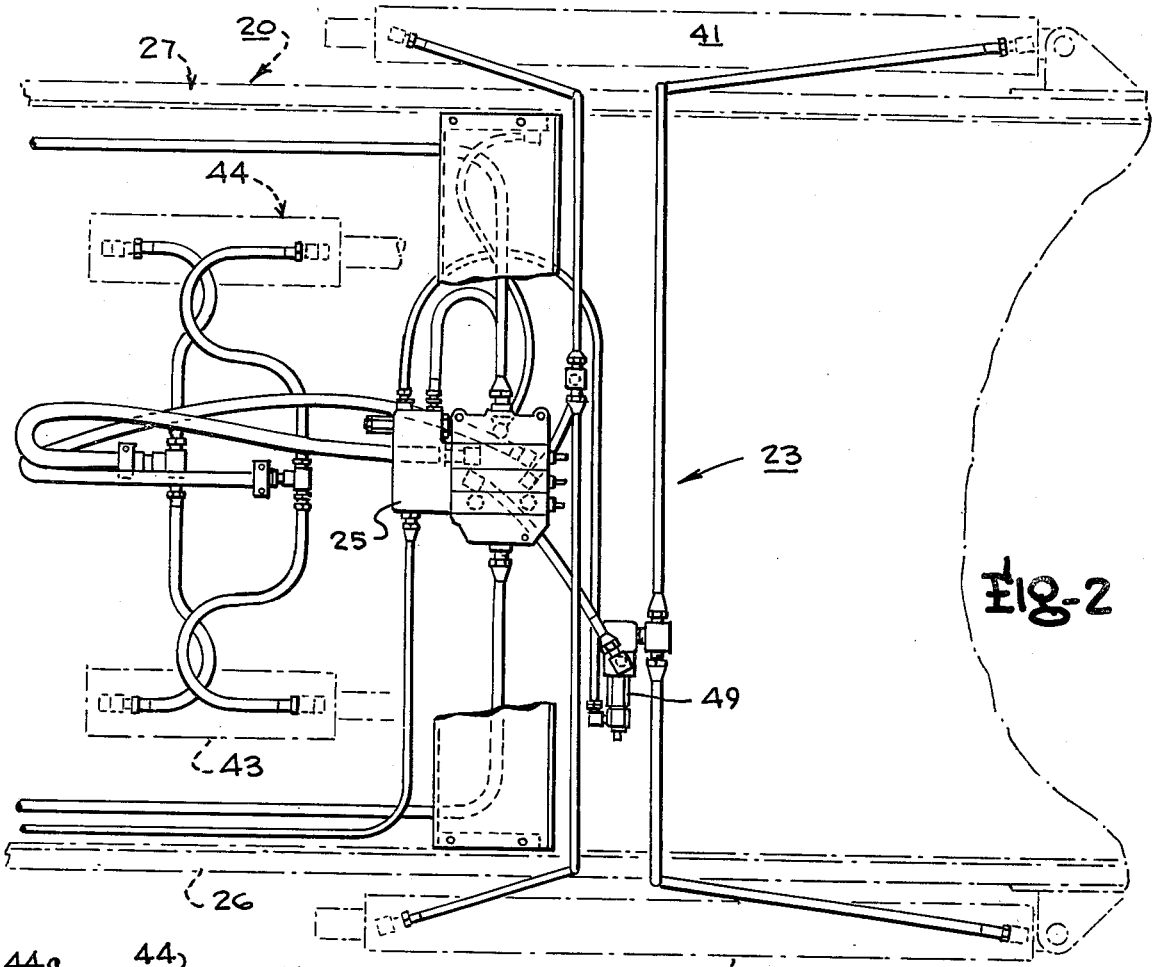
FIG. 2 is a top plan view of the control system shown diagrammatically in FIG. 1.

Referring to FIGS. 2 and 3, the refuse receiving hopper consists of a pair of side walls 26 and 27 pivotally connected at their upper ends to the upper rearward end of the storage body, bottom wall sections 28 and 29, and top wall sections 30 and 31, defining a forwardly disposed opening 32 communicating with the interior of the storage body and a rearwardly disposed opening 33 through which refuse may be charged into the interior of the receiving hopper. As best illustrated in FIG. 3, the interior of the hopper is provided with a transversely disposed, rearwardly and downwardly projecting deflector plate 34 having an upper surface 35 disposed parallel with the downwardly and rearwardly disposed longitudinal center line of the hopper, which provides a restricted passageway 36 intercommunicating the lower portion of the hopper interior with the interior of the storage body.

Provided in the side walls 26 and 27 of the hopper, along the longitudinal center line thereof, is a pair of elongated openings which function as a pair of transversely spaced tracks for guiding the mechanism 22 along the length of the hopper, as later will be described in detail. As shown in FIG. 3, bottom wall sections 28 and 29 are provided with an interior planar surface 37 disposed substantially parallel to the longitudinal center line of the hopper and which intersects substantially as a secant, an interior, curved surface 38 having an axis of curvature disposed within the plane including the longitudinal center line of the hopper. Refuse charged through the rear opening 33 of the hopper is deposited on surfaces 37 and 38 either by manually lifting and dumping refuse containers into the hopper or utilizing a power operated system to tilt larger refuse containers on brackets mounted on the rear end of the hopper adjacent the side walls 26 and 27. The packer mechanism generally consists of a carriage or carrier assembly 39 slidable along the downwardly and rearwardly disposed longitudinal center line of the receiving hopper, a pair of fluid actuated piston and cylinder assemblies 40 and 41 interconnecting the carrier assembly 39 and the side walls 26 and 27 of the refuse hopper for moving the carrier assembly rectilinearly along the longitudinal center line of the receiving hopper, a packer panel 42 pivotally connected at its forwardly disposed end to carrier assembly 39, and a pair of fluid actuated piston and cylinder assemblies 43 and 44 for pivoting the packer panel 42 relative to the carrier assembly 39.

The piston and cylinder assemblies 40 and 41 are mounted on the exterior side of the hopper side walls and lie in the plane of the longitudinal center line of the hopper. Fluid cylinders 40*a* and 41*a* of assemblies 40 and 41 are connected at their lower ends to brackets mounted on the side walls of the hopper. The free ends of piston rods 40*b* and 41*b* of the assemblies are operatively connected to brackets rigidly mounted on carrier assembly 39 which project laterally through the elongated openings in the hopper side walls. It thus will be seen that upon applying fluid under pressure to the ends of fluid cylinders 40*a* and 41*a*, piston rods 40*b* and 41*b* will be caused to extend and retract correspondingly to move the carrier assembly along the longitudinal center line of the hopper.

Piston and cylinder assemblies 43 and 44 include a pair of fluid cylinders 43*a* and 44*a* pivotally connected at their forward ends to a forwardly disposed upper portion of carrier assembly 39, and a pair of piston rods 43*b* and 44*b* which are pivotally connected at the three ends thereof to an arm portion 42*a* of the packer panel. As shown in FIG. 3, when fluid under pressure is applied selectively to the ends of fluid cylinders 43*a* and 44*a*, piston rods 43*b* and 44*b* will be cause to extend and retract, correspondingly to pivot the packer panel relative to the carrier assembly and thus provide a sweeping action of the packer panel. FIG. 3 further illustrates the sequential positions of the packer panel during a full cycle of the packer mechanism.

Figure 1:
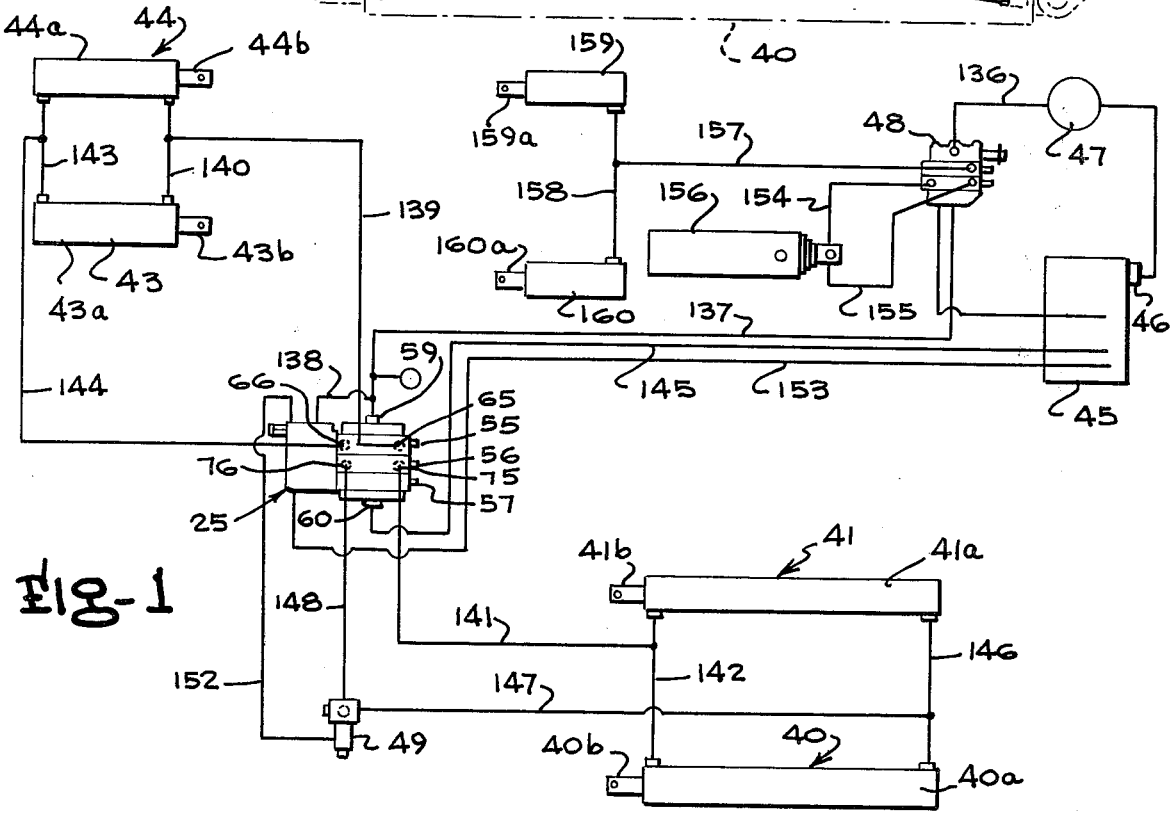
FIG. 1 is a diagrammatic view of a control system for the packer mechanism of a refuse collection vehicle, embodying the present invention.

The control system illustrated in FIGS. 1 and 2 is operable selectively to actuate the carrier piston and cylinder assemblies 40 and 41 and the packer panel piston and cylinder assemblies 43 and 44, to (a) cycle the packer mechanism within the receiving hopper, (b) swing the receiving hopper upwardly clear of the storage body, and (c) move the ejector panel longitudinally for ejecting refuse from the storage body. THe system includes a fluid tank 45 provided with a filter 46, a pump 47, a selector valve 48, the control valve 25, a sequence valve 49 and interconnecting fluid lines which will be described in connection with the operation of the system. Selector valve 48 and control valve 25 are spool type valves, the spools of which may be shifted along their lengths to divert fluid under pressure to various components of the system, as will be described.

Figure 7:
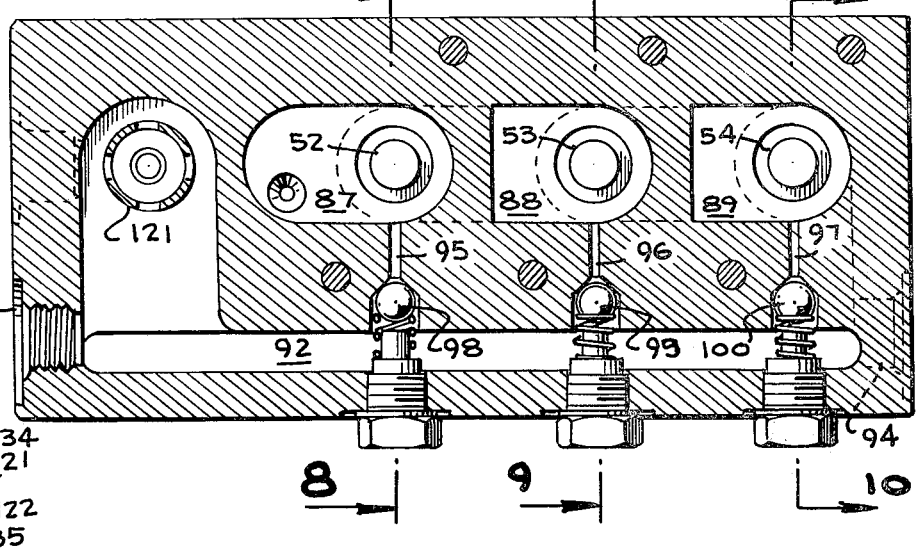
FIG. 7 is a cross-sectional view taken along line 7—7 in FIG. 6.
Figure 8:
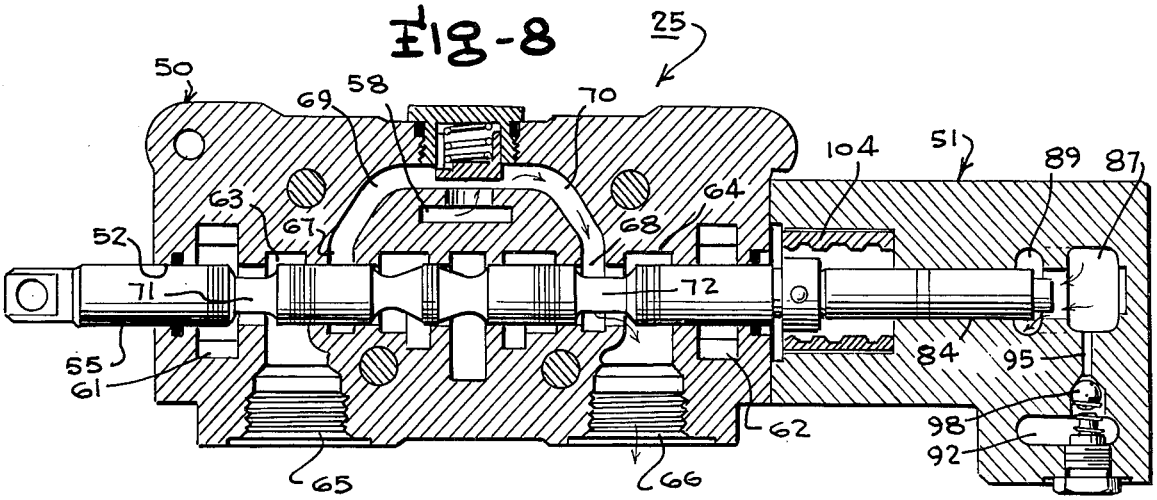
FIG. 8 is a cross-sectional view taken along line 8—8 in FIG. 7, illustrating the valve spool thereof in a fully retracted position.
Figure 9:
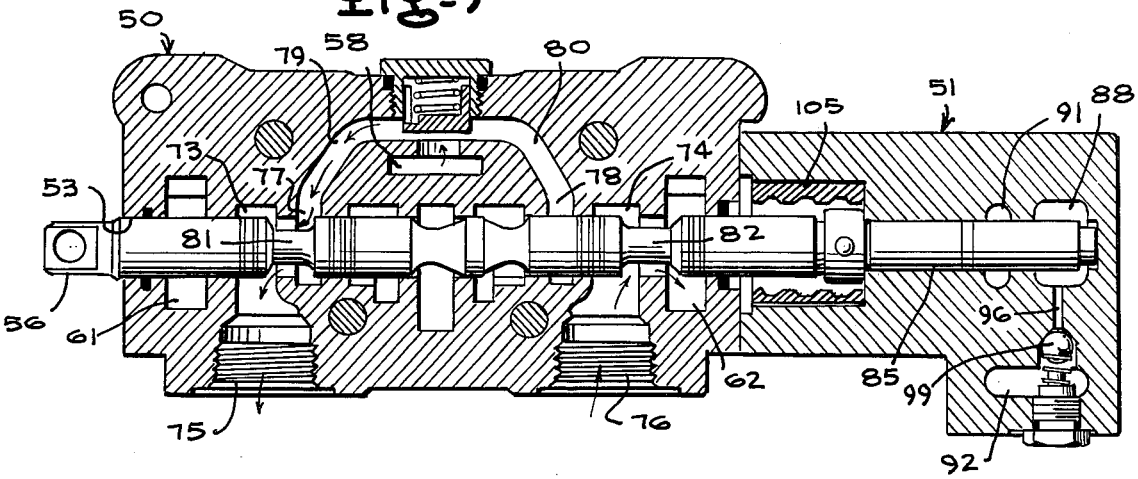
FIG. 9 is a cross-sectional view taken along line 9—9 in FIG. 7, illustrating the valve spool thereof in a fully inserted position.
Figure 10:
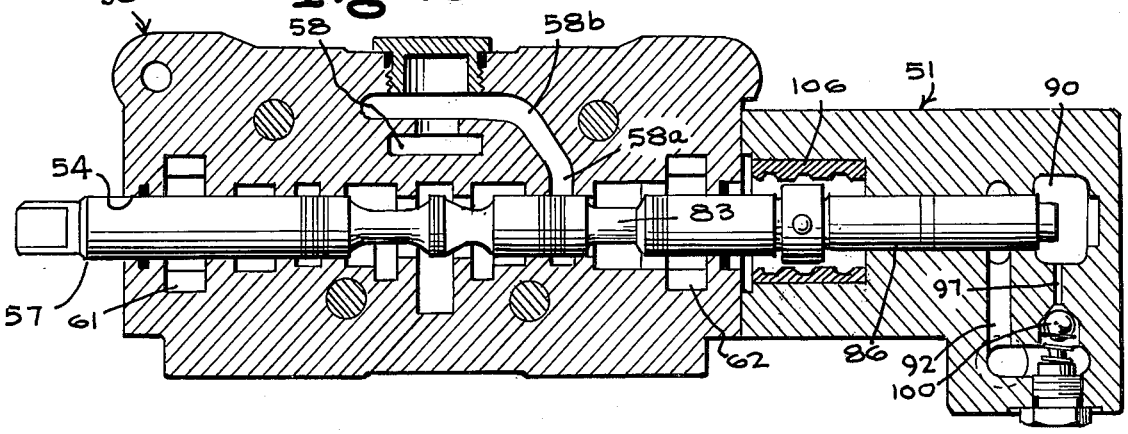
FIG. 10 is a cross-sectional view taken along line 10—10 in FIG. 7, illustrating the valve spool thereof in a position intermediate its fully retracted and inserted positions.

Referring to FIGS. 4 through 10, control valve 25 consists of a main valve section 50 and a pilot valve section 51. As best shown in FIGS. 8 through 10, main valve section 50 is provided with cylindrical bores 52, 53 and 54 in which there are disposed axially shiftable valve spools 55, 56 and 57, respectively. One set of ends of such valve spools project out of the main valve section and are adapted to be connected to an actuating mechanism 24, mounted on the hopper which is operable to insert the valve spools fully into the control valve as illustrated in FIG. 9, retract the valve spools fully as shown in FIG. 8 and move the valve spools to an intermediate position as illustrated in FIG. 10. Any form of actuating mechanism may be used to effect the shifting of the valve spools and correspondingly operate control valve 25. An example of an actuating mechanism which may be employed as disclosed in U.S. Pat. No. 3,822,797.

Figure 4:
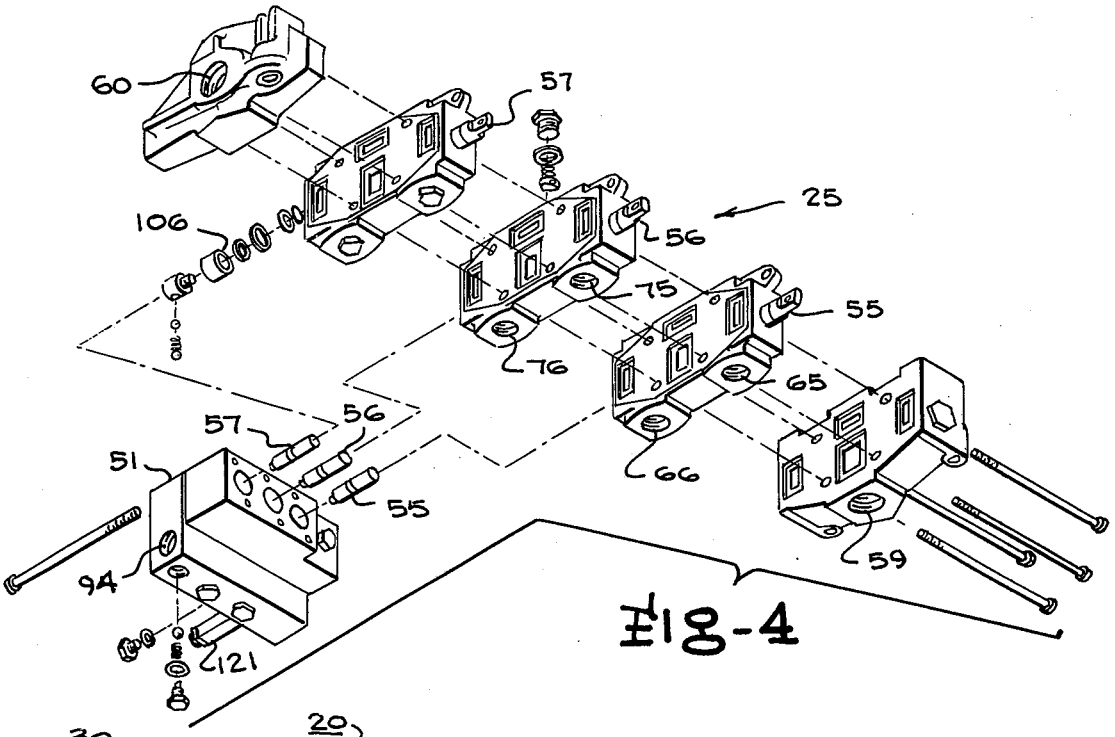
FIG. 4 is a perspective view of the control valve utilized in the system shown in FIGS. 1 and 2, illustrating the components thereof in exploded relation.
Figure 5:
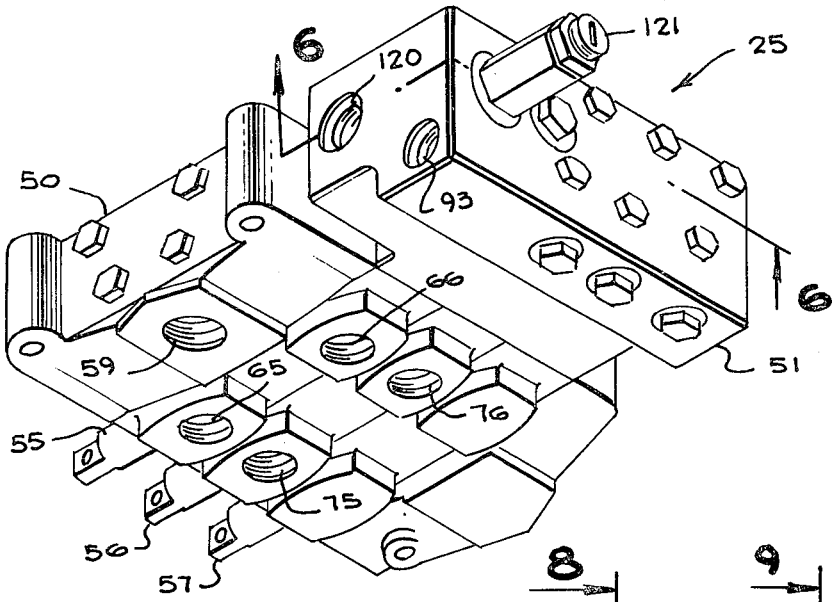
FIG. 5 is an enlarged perspective view of the control valve shown in FIG. 4.

Control valve 25 further is provided with a main fluid passageway 58 which intercommunicates an inlet port 59, as best shown in FIG. 5, and an outlet port 60, as best shown in FIG. 4. The valve further is provided with fluid drain passages 61 and 62 which intercommunicate the valve spool bores 52 through 54 adjacent the ends thereof, and outlet port 60.

Referring to FIG. 8, cylindrical bore 52 is provided with a pair of grooves 63 and 64 disposed inwardly relative to fluid drain passages 61 and 62, which communicate with a pair of ports 65 and 66. Spaced inwardly from grooves 63 and 64 are a pair of grooves 67 and 68 which communicate with main fluid passageway 58 by means of passageways 69 and 70. Valve spool 55 is provided with reduced portions 71 and 72 which are operable when valve spool 55 is in the fully inserted position to intercommunicate grooves 63 and 67 while intercommunicating groove 64 and fluid drained passageway 62, and are operable when the valve spool is in the fully retracted position, as shown in FIG. 8, to intercommunicate groove 63 with fluid drain passageway 61 while intercommunicating grooves 68 and 64.

Valve spool bore 53 similarly is provided with a pair of grooves 73 and 74 disposed inwardly relative to fluid drain passageways 61 and 62, which communicate with a pair of ports 75 and 76. Disposed inwardly of grooves 73 and 74 is a pair of grooves 77 and 78 which communicate with main fluid passageway 58 through passageways 79 and 80. Similar to valve spool 55, valve spool 56 is provided with reduced portions 81 and 82 which operate when valve spool 56 is in the fully inserted position, as illustrated in FIG. 9, to intercommunicate grooves 73 and 77 while intercommunicating groove 74 and fluid drain passageway 62, and operative when in the fully retracted position to intercommunicate fluid drain passageway 61 and groove 73 while intercommunicating grooves 78 and 74.

Valve spool bore 54 is provided with a groove **58*a* communicating with a passageway 58*b* which constitutes portions of main fluid passageway 58. Valve spool 57 is provided with a reduced portion 83 which operates when in the fully extended position to obstruct main fluid passageway 58 and when in the fully retracted position to permit flow through main passageway 58 between inlet port 59 and outlet port 60**.

Figure 6:
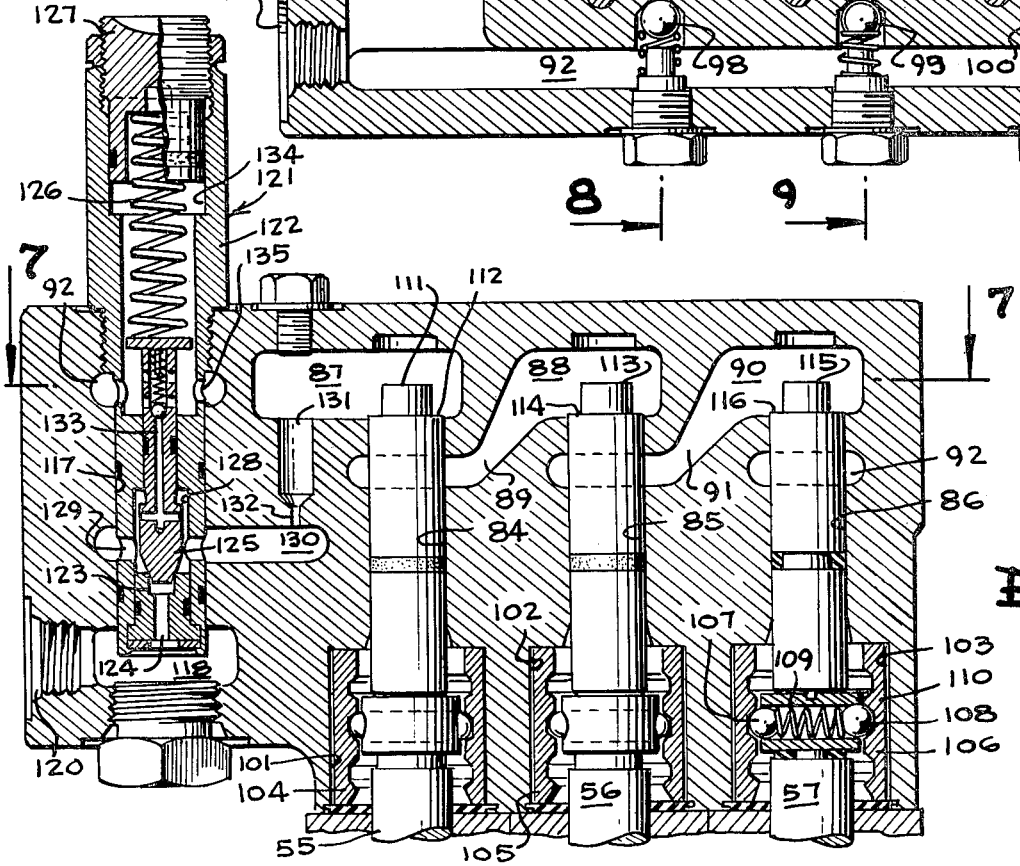
FIG. 6 is an enlarged cross-sectional view taken along line 6—6 in FIG. 5.

Pilot valve section 51 is mounted on an end of main valve section 50 and is provided with cylindrical bores 84, 85 and 86 which are disposed in alignment with bores 52, 53 and 54 of the main valve section, respectively, and receive end portions of valve spools 55, 56 and 57. As best illustrated in FIGS. 6 and 7, an end of valve spool bore 84 communicates with a chamber 87, an end of valve spool bore 85 communicates with a chamber 88 which in turn communicates through a passageway 89 with valve spool bore 84 at a point spaced axially from chamber 87, and an end of valve spool bore 86 communicates with a chamber 90 which in turn communicates through a passage 91 with valve spool bore 85 at a point spaced axially from a chamber 88. Valve spool bore 86 further communicates at a point spaced axially from chamber 90 with a fluid drain chamber 92 which is provided with ports 93 and 94. As best seen in FIG. 7, chambers 87, 88 and 90 communicate with fluid drain chamber 92 through relief passageways 95, 96 and 97 which are provided with spring biased, check valves 98, 99 and 100.

Valve spool bores 84, 85 and 86 are provided with enlarged portions 101, 102 and 103 adjacent the main valve section, in which there are provided spool retainer assemblies 104, 105 and 106. Such retainer assemblies are identical in construction and operation, and function to yieldingly retain each of the valve spools in the aforementioned fully inserted, fully retracted and intermediate positions. Assembly 106 is typical of the three assemblies and will be noted as being provided with a pair of detent balls 107 and 108 carried by valve spool 57 and urged apart by a spring 99, which are received in sets of grooves in a sleeve member 110 to yieldingly retain the valve spool in the aforementioned operative positions.

Referring to FIGS. 6 and 8 through 10, it will be noted that when valve spool 55 is in the fully inserted or intermediate position, communication between chamber 87 and passageway 89 will be obstructed by the end of valve spool 55, and when valve spool 55 is in the fully retracted position, as illustrated in FIG. 8, chamber 87 will communicate with passageway 89. Similarly, when valve spool 56 is in the fully inserted or intermediate position, the end of valve spool 56 will obstruct communication between chamber 88 and passageway 91, as shown in FIG. 9, and when valve spool 56 is in the fully retracted position, chamber 88 will communicate with passageway 91. In addition, when valve spool 57 is in the fully inserted or intermediate position, as shown in FIG. 10, the end portion of valve spool 57 will obstruct communication between chamber 90 and fluid drain passageway 92, and when valve spool 57 is in the fully retracted position, chamber 90 will communicate with fluid drain chamber 92.

Valve spool 55 is provided with an end surface 111 and an annular shoulder 112 which are constantly in communication with chamber 87 so that whenever fluid pressure in chamber 87 reaches a predetermined amount, valve spool 55 will be caused to shift axially from either the fully inserted or intermediate position to the fully retracted position intercommunicating chamber 87 with passageway 89. Similarly, valve spool 56 is provided with an end surface 113 and an annular shoulder 114 constantly in communication with chamber 88 so that whenever the fluid pressure in chamber 88 reaches a predetermined point, valve spool 56 will be caused to shift axially from either the fully inserted or intermediate position to the fully retracted position, communicating chamber 88 with passage 91. Also, valve spool 57 is provided with an end surface 115 and an annular shoulder 116 in constant communication with chamber 90 so that when the fluid pressure in chamber 90 reaches a predetermined point, valve spool 57 will be cause to shift axially from either the fully inserted or intermediate position to its fully retracted position, communicating chamber 90 with fluid drain passageway 92. In each of such instances, the pressures in chambers 87, 88 and 90 would have to be sufficient to overcome the spring forces of retainer assemblies 104, 105 and 106.

Pilot valve section 51 further is provided with a cylindrical bore 117 which communicates at an inner end thereof with a chamber 118 communicating with an inlet port 120. Disposed in bore 117 and extending at its inner end into chamber 118 is a poppet valve 121. Such valve includes a housing 122, a valve seat 123 having an axial passageway 124, mounted on the inner end thereof, a poppet 125 seated on valve seat 123 and a spring 126 disposed between an end of the poppet and a closure member 127 threaded into the outer end of the valve housing, for urging the poppet into seating engagement with the valve seat. The seating end of poppet 125 is disposed in a chamber 128 in the valve housing which communicates through openings 129 with a chamber 130 in the pilot valve section. Chamber 130 in turn communicates through a passageway 131 having an orifice 132 with chamber 87. Poppet 125 further is provided with a bleed passageway 133 having a check valve therein, intercommunicating chamber 128 of the housing with a housing chamber 134 containing the outer end of the poppet and biasing spring 126. Chamber 134 communicates with fluid drain passageway 92 by means of a plurality of openings 135 in the valve housing.

In the operation of the control system to cycle packer mechanism 22, when the carrier assembly and packer panel are in the positions as illustrated by the solid lines in FIG. 3, pump 47 is operating, and spools 55, 56 and 57 of control valve 25 are shifted inwardly to their fully inserted positions by means of control valve operating mechanism 24, to begin the cycling of packer mechanism 22, pump 47 provides fluid under pressure through a line 136, selector valve 48 and a line 137 to inlet port 59 and main fluid passageway 58 of control valve 25. Simultaneously, fluid under pressure will be supplied through line 138 to inlet port 120 and chamber 118 of the pilot section of control valve 25.

With valve spools 55 and 56 fully inserted, fluid is caused to flow through passageway 69, the spool bore portion between grooves 63 and 67 and outlet port 65 of the control valve, and through fluid lines 139 and 140 to the rod ends of cylinders 43*a* and 44*a*, and simultaneously through passageway 79, the valve spool portion between grooves 73 and 77 and port 75, and through fluid lines 141 and 142 to the rod ends of cylinders 40*a* and 41*a*. Under such conditions, piston rods 43*b* and 44*b* will be caused to retract. Fluid from the piston ends of cylinders 43a and 44a will be caused to flow through fluid lines 143 and 144, port 66, the spool bore portion between groove 64 and passageway 62, fluid drain passageway 62, outlet port 60 and a return line 145 to tank. Similarly, fluid from the piston ends of cylinders 40*a* and 41*a* will be caused to flow through fluid lines 146 and 147, sequence valve 49, fluid line 148, port 76, the spool bore portion between groove 74 and passageway 62, fluid drain passageway 62, outlet port 60 and return line 145 to tank.

Sequence valve 49 functions to restrict the flow of fluid from the piston ends of cylinders 40*a* and 41*a* until such time that pistons 43*b* and 44*b* have been fully retracted and the full pressure of the system is applied to the rod ends of cylinders 40*a* and 41*a*, whereupon, sequence valve 49 opens fully to permit pistons 40*b* and 41*b* to be fully retracted. The effect of such action is to cause the carrier assembly 39 to begin drifting rearwardly from a position A to a position B, as illustrated in FIG. 3, as rods 43*d* and 44*d* are caused to retract fully to pivot packer panel 42 upwardly to a position that is illustrated by the reference numeral 149.

When piston rods 40*b* and 41*b* become fully retracted, positioning packer panel 42 in the position designated by the reference numeral 150, the pressure in lines 137 and 138 or the system pressure will increase to a predetermined amount exceeding the spring pressure of poppet valve 121 thus causing poppet 125 to become unseated. Under such circumstances, fluid under pressure is caused to flow through chamber 118, axial passageway 124 of valve seat 123, chamber 128 in valve housing 122, openings 129, chamber 130 in pilot section 51, orifice 132, and passageway 131 into chamber 87. The force of the fluid in chamber 87 then acts on end face 111 and annular shoulder 112 of spool 55 to overcome the retaining force of holding assembly 104 and shift valve spool 55 axially to its fully retracted position, as illustrated in FIG. 8.

With valve spool 55 in the position as illustrated in FIG. 8, fluid under pressure is caused to flow through passageway 70, the spool bore portion between grooves 68 and 64, port 66, and fluid lines 144 and 143 to the piston ends of cylinders 43*a* and 44*a* to extend piston rods 43*b* and 44*b* and thus pivot the packer panel downwardly from the position designated by reference numeral 150 to the position designated by the reference numeral 151, in FIG. 3. While piston rods 43*b* and 44*b* are extending, fluid from the rod ends of cylinders 43*a* and 44*a* is discharged through fluid lines 140 and 139, port 65 of the control valve, the spool bore portion between groove 63 and passageway 61, fluid drain passageway 61, outlet port 60 and through return line 145 to tank.

When piston rods 43*b* and 44*b* are fully extended so that the packer panel is in the position designated by the reference numeral 151, the system pressure again increases to a predetermined amount sufficient to open poppet valve 121 again and supply fluid under pressure to chamber 130, orifice 132, passageway 131, chamber 87, past the retracted end of spool 55, through passageway 89 to chamber 88. Under such circumstances, the fluid pressure in chamber 88 will cause spool 56 to shift axially to its fully retracted position, intercommunicating chamber 88 and passageway 91.

The shifting of valve spool 56 to its fully retracted position will cause fluid under pressure to be supplied through passageway 80 in the control valve, the spool bore portion between grooves 78 and 74, port 76, fluid line 148, sequence valve 49 and fluid lines 147 and 146 to the piston ends of cylinders 40*a* and 41*a* to extend piston rods 40*b* and 41*b*. The extension of piston rods 40*b* and 41*b* will have the effect of causing the carrier assembly to be moved upwardly to its uppermost position thus moving the packer panel from the position designated by the reference numeral 151 to its original starting position as illustrated by the solid lines in FIG. 3. The cycling of packer panel 42 thus will have been completed.

While piston rods 40*b* and 41*b* are extending to return the packer panel to its original position, fluid in the rod ends of cylinders 40*a* and 41*a* will be discharged through fluid line 141, port 75 of the control valve, the spool bore portion between groove 73 and passageway 61, fluid drain passageway 61, outlet 60 and fluid line 145 to tank.

Although sequence valve 49 functions to restrict the flow of fluid from the piston ends of cylinders 40*a* and 41*a* when piston rods 40*b* and 41*b* are being restricted, until such time as the fluid pressure in fluid lines 141 and 142 reach a predetermined amount, the sequence valve is free flowing in the opposite direction so that it will not function to impede the supply of fluid to the piston ends of cylinders 40*a* and 41*a* when fluid under pressure is applied to fluid line 148. Furthermore, it is to be noted that fluid leaking from the sequence valve may be conducted through a fluid line 152 to port 93 of pilot valve section 51 and through fluid drain passageway 92 to port 94 which is connected to tank through fluid line 153.

When the packer mechanism returns to the position as illustrated in FIG. 3, the system pressure than again increases to a predetermined amount, again causing poppet valve 121 to open and supply fluid under pressure through chambers 130, 87, 88 and 90, and their interconnecting passageways to shift valve spool 57 to its fully retracted position. Under such circumstances, main fluid passageway 58 in the control valve will be communicated through drain passageway 62 with outlet port 60 and return line 145 to tank. The system would then be in condition to actuate operating mechanism 24 to repeat the cycling of packer mechanism.

With valve spool 57 in the fully retracted position at the close of the cycle, chamber 90 will communicate with fluid drain passageway 92 to permit any residual fluid in chambers 87, 88 and 90 to return to tank. Prior to the full retraction of the valve spools, it will be seen that excess pressures in chambers 87, 88 and 90 may be relieved through relief passages 95, 96 and 97. In addition, it will be noted that chamber 118, the inner end of valve bore 117, chamber 130, orifice 132, passageway 131, chamber 89, and end of spool bore 84, passageway 89, chamber 88, an end portion of spool bore 85, passageway 91, chamber 90, a portion of spool bore 86 and drain passageway 92 provide a pilot passageway between inlet port 120 and outlet port 94 which is subject to system pressure for sequentially shifting valve spools 55, 56 and 57 to sequentially communicate main fluid passageway 58 of main valve section 50 with the opposite ends of the cylinders of the packer mechanism to provide the desired cycling of the packer panel.

Selector valve 48 may be operated in the conventional manner to supply fluid under pressure through fluid lines 154 and 155 to the opposite ends of the cylinder 156 for moving the ejector panel longitudinally either to compact refuse in the storage body or to eject refuse therefrom. When refuse is to be ejected from the refuse body, the selector valve is operated to supply fluid under pressure through fluid lines 157 and 158 to the piston ends of a pair of cylinders 159 and 160 to extend pistons 159a and 160a thereof and pivot the refuse hopper to an elevated position, to permit the ejector panel to move rearwardly and eject refuse from the storage body.

From the foregoing detailed description, it will be evident that there are a number of changes, adaptations and modifications of the present invention which come within the province of those persons skilled in the art to which such invention pertains. However, it is intended that all such variations not departing from the spirit of the invention be considered as within the scope thereof as limited solely by the appended claims.

We claim:

1. In a refuse collection vehicle provided with a mechanism mounted on a refuse receiving hopper thereof for transferring refuse deposited in said hopper into a storage body and compacting the refuse therein, said mechanism including a panel engageable with refuse deposited in said refuse receiving hopper, a first fluid actuated component operatively connected to said panel and a second fluid actuated component operatively connected to said panel and cooperable with said first fluid actuated component for cycling said panel through a predetermined cycle, a control system for operating said fluid actuated components comprising a fluid tank; a pump having an inlet communicating with said tank; a control valve having a main fluid passageway therethrough communicating at an inlet port thereof with the outlet of said pump and at an outlet port thereof with said tank, a pilot fluid passageway therethrough communicating at an inlet port thereof with the outlet of said pump and at an outlet port thereof with said tank, a first valve spool selectively operable for communicating the inlet port of said main fluid passageway with said first fluid actuated component, said first spool being displaceable between a first position obstructing said pilot fluid passageway and a second position not obstructing said pilot fluid passageway, said first valve spool having a surface disposed at an angle relative to a longitudinal axis thereof communicating with said pilot fluid passageway, and a second valve spool selectively operable for communicating the inlet port of said main fluid passageway with said second fluid actuated component, said second valve spool being displaceable between a first position obstructing said pilot fluid passageway at a point thereof between the point of obstruction of said first valve spool and the outlet port of said pilot fluid passageway, and a second position not obstructing said pilot fluid passageway said second valve spool having a surface disposed at an angle relative to a longitudinal axis thereof communicating with said pilot fluid passageway; and a means for shifting said first and second valve spools to said first positions thereof.

2. A control system according to claim 1 wherein portions in which the bores of said valve spools are disposed comprise portions of said pilot fluid passageway which are obstructed by said valve spools when said valve spools are disposed in said first positions thereof.

3. A control system according to claim 1 including a poppet valve disposed in said pilot fluid passageway between the inlet port thereof and the point of obstruction of said first valve spool, said poppet valve being adapted to open under a predetermined pressure.

4. A control system according to claim 1 wherein said control valve includes first and second fluid supply ports communicating with said first fluid actuated component; wherein said first valve spool is operative when in the first position thereof for communcating the inlet port of said main fluid passageway with said first supply port while communicating the outlet port of said main fluid passageway with said second supply port, and operative when in the second position thereof for communicating the inlet port of said main fluid passageway with said second supply port while communicating the outlet port of said main fluid passageway with said first supply port; includes third and fourth fluid supply ports communicating with said second fluid actuated component; and wherein said second valve spool is operative when in said position thereof for communicating the inlet port of said main fluid passageway with said third supply port while communicating the outlet port of said main fluid passageway with said fourth supply port, and operative when in said second position thereof for communicating the inlet port of said main fluid passageway with said fourth supply port while communicating the outlet port of said main fluid passageway with said third supply port.

5. A control system according to claim 1 wherein said control valve includes a third valve spool displaceable between a first position obstructing said main fluid passageway and obstructing said pilot fluid passageway at a point between the point of obstruction of said second valve spool and the outlet port of said pilot fluid passageway, and a second position not obstructing said main fluid passageway and said pilot fluid pssageway, said third valve spool having a surface disposed at an angle relative to a longitudinal axis thereof communicating with said pilot fluid passageway; and including means for shifting said third valve spool to said first position thereof.

6. A control system according to claim 5 wherein portions in which the bores of said valve spools are disposed comprise portions of said pilot fluid passageway which are obstructed by said valve spools when said valve spools are disposed in said first positions thereof.

7. A control system according to claim 5 including a poppet valve disposed in said pilot fluid passage between the inlet port thereof and the point of obstruction of said first valve spool, said poppet valve being adapted to open under a predetermined pressure.

8. A control system according to claim 5 wherein said control valve includes first and second fluid supply ports communicating with said first fluid actuated component; wherein said first valve spool is operative when in the first position thereof for communicating the inlet port of said main fluid passageway with said first fluid supply port while communicating the outlet port of said main fluid passageway with said second supply port, and operative when in the second position thereof for communicating the inlet port of said main fluid passageway with said second supply port while communicating the outlet port of said main fluid passageway with said first supply port; includes third and fourth fluid supply ports communicating with said second fluid actuated component; wherein said second valve spool is operative when in said first position thereof for communicating the inlet port of said main fluid passageway with said third supply port while communicating the outlet port of said main fluid passageway with said fourth supply port, and operative when in said second position thereof for communicating the inlet port of said main fluid passageway with said fourth supply port while communicating the outlet port of said main fluid passageway with said third supply port; and wherein said third valve spool is operative when in said first position thereof for obstructing said main fluid passageway, and operative when in said second position thereof for not obstructing said main fluid passageway.

9. A control system according to claim 1 wherein said control valve includes means for yieldingly retaining said valve spools in said first and second positions thereof.

10. A control system according to claim 5 wherein said control valve includes means for yieldingly retaining said valve spools in said first and second positions thereof.

11. A control valve for a fluid system comprising a housing, said housing having a main fluid passageway therethrough including an inlet port communicable with a source of fluid under pressure and an outlet port communicable with a fluid tank, said housing having a pilot fluid passageway therethrough including an inlet port communicable with said source of fluid under pressure and an outlet port communicable with said fluid tank; a first valve spool selectively operable for communicating said inlet port of said main fluid passageway with first and second fluid supply ports, said first spool being displaceable between a first position obstructing said pilot fluid passageway and a second position not obstructing said pilot fluid passageway, said first valve spool having a surface disposed at an angle to a longitudial axis thereof communicating with said pilot fluid passageway; and a second valve spool selectively operable for communicating said inlet port of said main fluid passageway with third and fourth fluid supply ports, said second valve spool being displaceable between a first position obstructing said pilot fluid passageway at a point between the point of obstruction of said first valve spool and the outlet port of said pilot fluid passageway, said second valve spool having a surface disposed at an angle relative to a longitudinal axis thereof communicating with said pilot fluid passageway.

12. A control valve according to claim 11 wherein portions in which the bores of said valve spools are disposed comprise portions of said pilot fluid passageway which are obstructed by said valve spools when said valve spools are disposed in said first positions thereof.

13. A control valve according to claim 11 including a poppet valve disposed in said pilot fluid passageway between the inlet port thereof and the point of obstruction of said first valve spool, said poppet valve being adapted to open under a predetermined pressure.

14. A control valve according to claim 11 wherein said first valve spool is operative when in the first position thereof for communicating the inlet port of said main fluid passageway with said first supply port while communicating the outlet port of said main fluid passageway with said second supply port, and operative when in the second position thereof for communicating the inlet port of said main fluid passageway with said second supply port while communicating the outlet port of said main fluid passageway with said first supply port; and wherein said second valve spool is operative when in said first position thereof for communicating the inlet port of said main fluid passageway with said third supply port while communicating the outlet port of said main fluid passageway with said fourth supply port, and operative when in said second position thereof for communicating the inlet port of said main fluid passageway with said fourth supply port while communicating the outlet port of said main fluid pasageway with said third supply port.

15. A control valve according to claim 11 including a third valve spool displaceable between a first position obstructing said pilot fluid passageway at a point thereof between the point of obstruction of said second valve spool and the outlet port of said pilot fluid passageway, and a second position not obstructing said pilot fluid passageway, said third valve spool having a surface disposed at an angle relative to a longitudinal axis thereof communicating with said pilot fluid passageway.

16. A control valve according to claim 15 wherein portions in which the bores of said valve spools are disposed comprise portions of said pilot fluid passageway which are obstructed by said valve spools when said valve spools are disposed in said first positions thereof.

17. A control valve according to claim 15 including a poppet valve disposed in said pilot fluid passageway between the inlet port thereof and the point of obstruction of said first valve spool, said poppet valve being adapted to open under a predetermined pressure.

18. A control valve accordng to claim 15 wherein said first valve spool is operative when in the first position thereof for communicating the inlet port of said main fluid passageway with said first supply port while communicating the outlet port of said main fluid passageway with said second supply port, and operative when in second position thereof for communicating the inlet port of said main fluid passageway with said second supply port while communicating the outlet port of said main fluid passageway with said first supply port; wherein said second valve spool is operative when in said first position thereof for communicating the inlet port of said main fluid passageway with said third supply port while communicating the outlet port of said main fluid passageway with said fourth supply port, and operative when in said second position thereof for communicating the inlet port of said main fluid passageway with said fourth supply port while communicating the outlet port of said main fluid passageway with said third supply port; and wherein said third valve spool is operative when in said first position thereof for obstructing said main fluid passageway, and operative when in said second position thereof for not obstructing said main fluid passageway.

19. A control valve according to claim 11 including means for yieldingly retaining said valve spools in said first and second positions thereof.

20. A control valve according to claim 15 including means for yieldingly retaining said valve spools in said first and second positions thereof.

* * * * *